US011471737B1

(12) United States Patent
Erickson

(10) Patent No.: US 11,471,737 B1
(45) Date of Patent: Oct. 18, 2022

(54) ADJUSTABLE PITCHING TRAINER

(71) Applicant: Craig M. Erickson, Deephaven, MN (US)

(72) Inventor: Craig M. Erickson, Deephaven, MN (US)

( * ) Notice: Subject to any disclaimer, the term of this patent is extended or adjusted under 35 U.S.C. 154(b) by 0 days.

(21) Appl. No.: 17/069,366

(22) Filed: Oct. 13, 2020

Related U.S. Application Data

(63) Continuation of application No. 16/359,660, filed on Mar. 20, 2019, now Pat. No. 10,799,780.

(60) Provisional application No. 62/645,434, filed on Mar. 20, 2018.

(51) Int. Cl.

| | |
|---|---|
| ***A63B 69/00*** | (2006.01) |
| ***A63B 59/20*** | (2015.01) |
| ***A63B 63/00*** | (2006.01) |
| ***A63B 102/18*** | (2015.01) |

(52) U.S. Cl.
CPC ..... *A63B 69/0002* (2013.01); *A63B 59/20* (2015.10); *A63B 2063/002* (2013.01); *A63B 2069/0006* (2013.01); *A63B 2102/18* (2015.10); *A63B 2210/52* (2013.01); *A63B 2225/093* (2013.01)

(58) Field of Classification Search
CPC ..... A63B 69/00; A63B 69/0002; F41J 1/10
See application file for complete search history.

(56) References Cited

U.S. PATENT DOCUMENTS

| | | | | |
|---|---|---|---|---|
| 3,312,467 | A * | 4/1967 | Dawson | A63B 69/0002 473/454 |
| 3,456,945 | A * | 7/1969 | Epply | A63B 69/0097 473/435 |
| 3,633,909 | A | 1/1972 | Doynow | |
| 4,239,235 | A | 12/1980 | Torres | |
| 4,497,485 | A * | 2/1985 | Macosko | A63B 63/00 273/401 |
| 4,629,188 | A | 12/1986 | Mahieu | |
| 4,783,070 | A | 11/1988 | Bauer et al. | |
| 4,863,166 | A | 9/1989 | Becera | |
| 5,083,774 | A * | 1/1992 | Yalvac | A63B 63/00 473/456 |
| 5,333,856 | A | 8/1994 | Gery | |
| 5,348,291 | A | 9/1994 | Scully | |
| 5,511,775 | A | 4/1996 | Parks | |
| 5,516,115 | A | 5/1996 | McLain | |
| 5,564,711 | A | 10/1996 | Scheie | |
| 5,803,841 | A | 9/1998 | Daskoski | |

(Continued)

OTHER PUBLICATIONS

Google Search "Baseball + Pitching", 3 pages.

(Continued)

*Primary Examiner* — Eugene L Kim
*Assistant Examiner* — Christopher Glenn
(74) *Attorney, Agent, or Firm* — Christensen, Fonder, Dardi & Herbert PLLC; Stuart J. Olstad

(57) ABSTRACT

A pitching target assembly for training baseball or softball pitchers. A target defines a plurality of zones, each being backed by a pocket or pouch for catching the baseball or softball. The height of the target can be adjusted to match that of a batter. The zones of the target may be adjusted as well, to tailor the targeting within the zone for specific purposes. The target may also be configured at an acute angle relative to a base plane of the pitching target assembly for practicing drop pitches.

7 Claims, 11 Drawing Sheets

(56) References Cited

U.S. PATENT DOCUMENTS

| | | | | |
|---|---|---|---|---|
| 6,093,120 | A | 7/2000 | Luke, Jr. | |
| 6,402,641 | B1 | 6/2002 | Lee | |
| 6,508,729 | B1 | 1/2003 | Coltrane et al. | |
| 6,808,463 | B1 * | 10/2004 | Stockwell, III | A63B 71/028 473/476 |
| 7,160,214 | B1 | 1/2007 | Rome | |
| 8,771,107 | B1 * | 7/2014 | Ayala | A63B 69/0002 473/456 |
| 8,905,870 | B1 | 12/2014 | Stafford | |
| 9,056,232 | B2 | 6/2015 | Rigoli | |
| 2002/0049103 | A1 | 4/2002 | Treihart | |
| 2002/0151387 | A1 | 10/2002 | Henson | |
| 2004/0014538 | A1 | 1/2004 | Bennett | |
| 2006/0131812 | A1 * | 6/2006 | Caruso | A63B 63/004 273/407 |
| 2009/0298622 | A1 * | 12/2009 | Roberts | G01P 15/00 367/90 |
| 2010/0081513 | A1 | 4/2010 | La Pointe | |
| 2012/0040769 | A1 | 2/2012 | Swingle et al. | |
| 2013/0190109 | A1 * | 7/2013 | Rigoli | A63B 63/00 473/478 |
| 2016/0263455 | A1 | 9/2016 | Holland | |
| 2017/0197126 | A1 | 7/2017 | Richter | |

OTHER PUBLICATIONS https://baseballtips.com/product/the-pitchers-pocket-pitching-target/ "The Pitchers Pocket Pitching Target for Training Baseball & Softball Players!", 8 pages.

* cited by examiner

ADJUSTABLE PITCHING TRAINER

RELATED APPLICATIONS

This patent application is a continuation of U.S. patent application Ser. No. 16/359,660, filed Mar. 20, 2019, now U.S. Pat. No. 10,799,780, issued Oct. 13, 2020, which claims the benefit of U.S. Provisional Patent Application No. 62/645,434, filed Mar. 20, 2018, the disclosures of which are hereby incorporated by reference in their entirety.

FIELD OF THE DISCLOSURE

This application is directed generally to sports equipment and more specifically to a target for training pitchers.

BACKGROUND OF THE DISCLOSURE

Pitching trainers or targets are devices that enable a baseball or softball pitcher to practice pitching without need of another person to catch the ball. Some conventional pitching trainers include a plurality of target zones, so that a pitcher can hone his or her craft by targeting certain subzones of the strike zone.

Conventional pitching trainers have target zones that are of fixed dimensions, or not easily altered. This "one size fits all" is detrimental where the pitching trainer may be used to train a wide range of athletes, from beginning baseball and softball players in elementary school to more seasoned pitching athletes at the high school or even college level. Also, conventional pitching trainers do not work well for practicing drop pitches that are ubiquitous at advanced levels of baseball pitching. "Drop pitches" are those pitches where the ball loses altitude in the latter stages of flight, creating a sharp downward trajectory relative to other pitches. A pitching trainer that overcomes these shortcomings would be welcomed.

SUMMARY OF THE DISCLOSURE

Various embodiments of the disclosure provide a versatile, multi-zone pitching target assembly for training baseball and softball pitchers. The pitching target assembly is configured to define a plurality of zones, each being backed by a pocket or pouch for catching the baseball or softball. The height of the target can be adjusted to simulate the strike zone for batters of different height. The zones of the pitching target assembly may be adjusted as well, to tailor the targeting within the zone for specific training purposes. In some embodiments, a target frame in which the plurality of zones are defined may be configured at an acute angle relative to a base plane of the pitching target assembly for practicing drop pitches.

Structurally, various embodiments of the disclosure include a pitching target assembly for baseball or softball pitching, comprising a base frame defining a base plane, a pair of struts pivotally coupled to the base frame, a target frame slidingly coupled to the pair of struts, the target frame including a pair of side members separated by a pair of lateral members to define a rectangular opening, a plurality of vertically extending elastic cords extending from and between the pair of lateral members, the vertically extending elastic cords including terminations at opposed ends thereof, a plurality of horizontally extending elastic cords extending from and between the pair of side members, the horizontally extending elastic cords including terminations at opposed ends thereof, and a netting coupled to the plurality of vertically extending elastic cords and the plurality of horizontally extending elastic cords. The plurality of vertically extending elastic cords and the plurality of horizontally extending elastic cords define a plurality of grid zone perimeters, each grid zone perimeter bounding a respective grid zone. The netting defines a plurality of pockets, each of the plurality of pockets being coupled to a respective one of the plurality of grid zone perimeters. The target frame is configured to translate relative to the pair of struts and is configured for coupling to the pair of struts at a plurality of selected locations along the pair of struts. In some embodiments, the pair of struts may extend into the pair of side members. The plurality of vertically extending elastic cords may be anchored to inside portions of the pair of lateral members and extend into the pair of lateral members, and the plurality of horizontally extending elastic cords may be anchored to inside portions of the pair of side members and extend into the pair of side members. In some embodiments, the acute angle is in a range of 30 degrees to 60 degrees inclusive. In some embodiments, acute angle is in a range of 35 degrees to 55 degrees inclusive. In some embodiments, the acute angle is in a range of 40 degrees to 50 degrees inclusive.

In some embodiments, the pair of struts and the base frame are configured to selectively support the target frame in one of an upright configuration and in an angular configuration, the pair of side members extending perpendicular to the base plane in the upright configuration, the pair of side members extending at an acute angle relative to the base plane in the angular configuration. The pair of lateral members may be configured for laterally positioning at least one of the plurality of vertically extending elastic cords at selected locations along the pair of lateral members, and the pair of side members may also be configured for vertically positioning at least one of the plurality of horizontally extending elastic cords at selected locations along the pair of side members, for changing the sizes of the grid zones.

The inside portions of each of the pair of lateral members and the inside portions of the pair of each of the side members define a plurality of registration slots, each registration slot of the plurality of registration slots defining an elongate slot portion defining a length and a width, the length being greater than the width, and a plurality of seating apertures disposed along the elongate slot portion, each of the plurality of seating apertures defining a dimension that is greater than the width of the elongate slot portion. The vertically extending elastic cords extend through the plurality of registration slots into the pair of lateral members, and the horizontally extending elastic cords extend through the plurality of registration slots into the pair of side members.

Each of the terminations of the plurality of vertically extending elastic cords and each of the terminations of the plurality of horizontally extending elastic cords may include a fixture dimensioned to be captured within a respective one of the registration slots. In some embodiments, a spherical profile is defined over at least a portion of the fixture, the spherical profile being configured to register within a selected one of the plurality of seating apertures. In some embodiments, the fixture is a stepped cylinder that includes a skirt portion and a neck portion that are joined at a shoulder portion, the skirt portion defining an outer diameter that is greater than an outer diameter defined by the neck portion, the neck portion extending through a respective one of the plurality of seating apertures such that the shoulder portion is registered adjacent the seating aperture. The registration slot may define an access port, the access port being dimensioned to enable the fixture to pass therethrough. A plug may also be configured to engage a perimeter of the access port.

In some embodiments, each of the pair of struts defines a longitudinal slot that extends over at least a portion thereof, each of the longitudinal slots being adjacent the inside portion of a respective one of the pair of side members to enable the strut to slide over the terminations of the horizontally extending elastic cords anchored to the inside portion of the side members. Each of the pair of struts may be a channel, the longitudinal slot is defined by an open side of the channel.

In various embodiments of the disclosure, a method for training a baseball pitcher to throw drop pitches is disclosed, comprising: providing a pitching target assembly configured to selectively position a target frame in an orientation that defines an acute angle relative to a vertical orientation; and providing instructions on a tangible, non-transitory medium, the instructions including orienting the target frame to define the acute angle relative to a base frame of the pitching target assembly, thereby defining an acute angle relative to a vertical orientation.

In various embodiments of the disclosure, a method for training a baseball pitcher to throw drop pitches is disclosed, comprising providing a pitching target assembly configured to selectively resize a plurality of grid zones within a rectangular target frame of the pitching target assembly, and providing instructions on a tangible, non-transitory medium, the instructions including: selectively locating a first termination of an elastic cord along a first registration slot at a first selected position, the first registration slot being defined on a first member of the rectangular target frame; and selectively locating a second termination of the elastic cord along a second registration slot at a second selected position, the second registration slot being defined on a second member of the rectangular target frame, the first member and the second member being on opposed sides of the rectangular target frame, the first termination and the second termination of the elastic cord being disposed on opposing ends of the elastic cord. In some embodiments, the method includes disposing the first termination of the elastic cord within a first seating aperture of the first registration slot, and disposing the second termination of the elastic cord within a second seating aperture of the second registration slot.

DETAILED DESCRIPTION OF THE FIGURES

Figure 1:
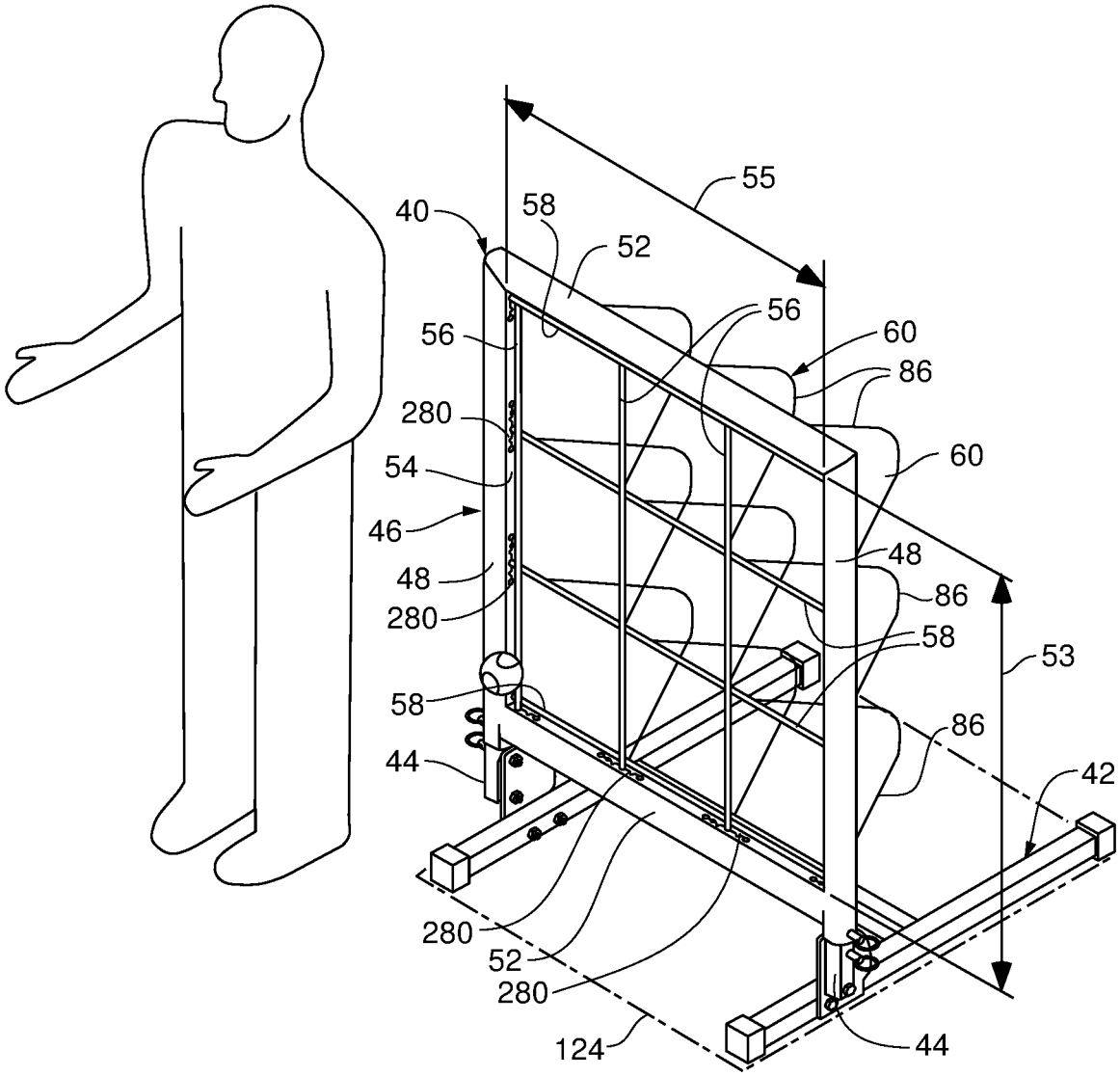
FIG. 1 includes a front perspective view of a pitching target assembly according to an embodiment of the disclosure.
Figure 2:
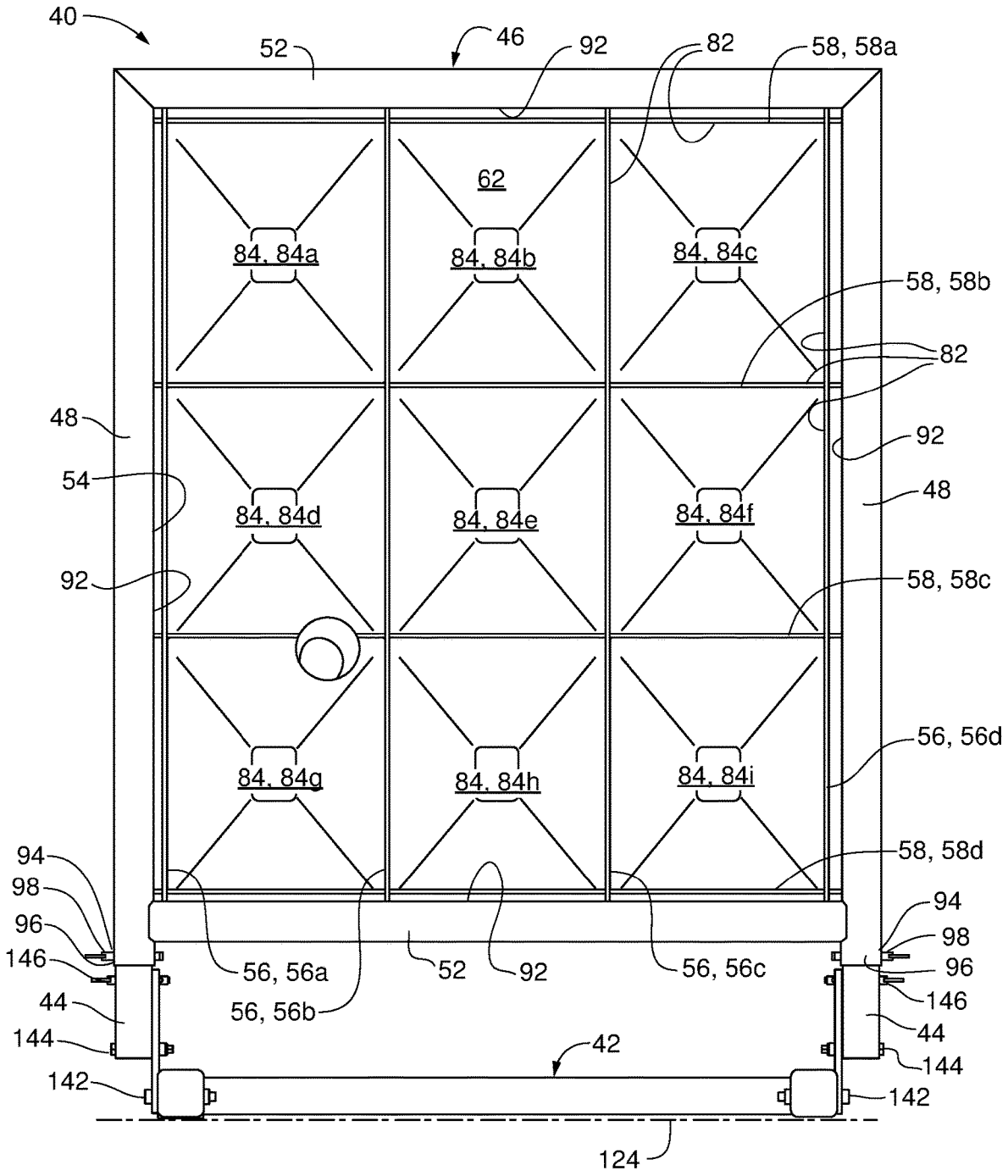
FIG. 2 includes a front elevational view of the pitching target assembly of FIG. 1 according to an embodiment of the disclosure.
Figure 3:
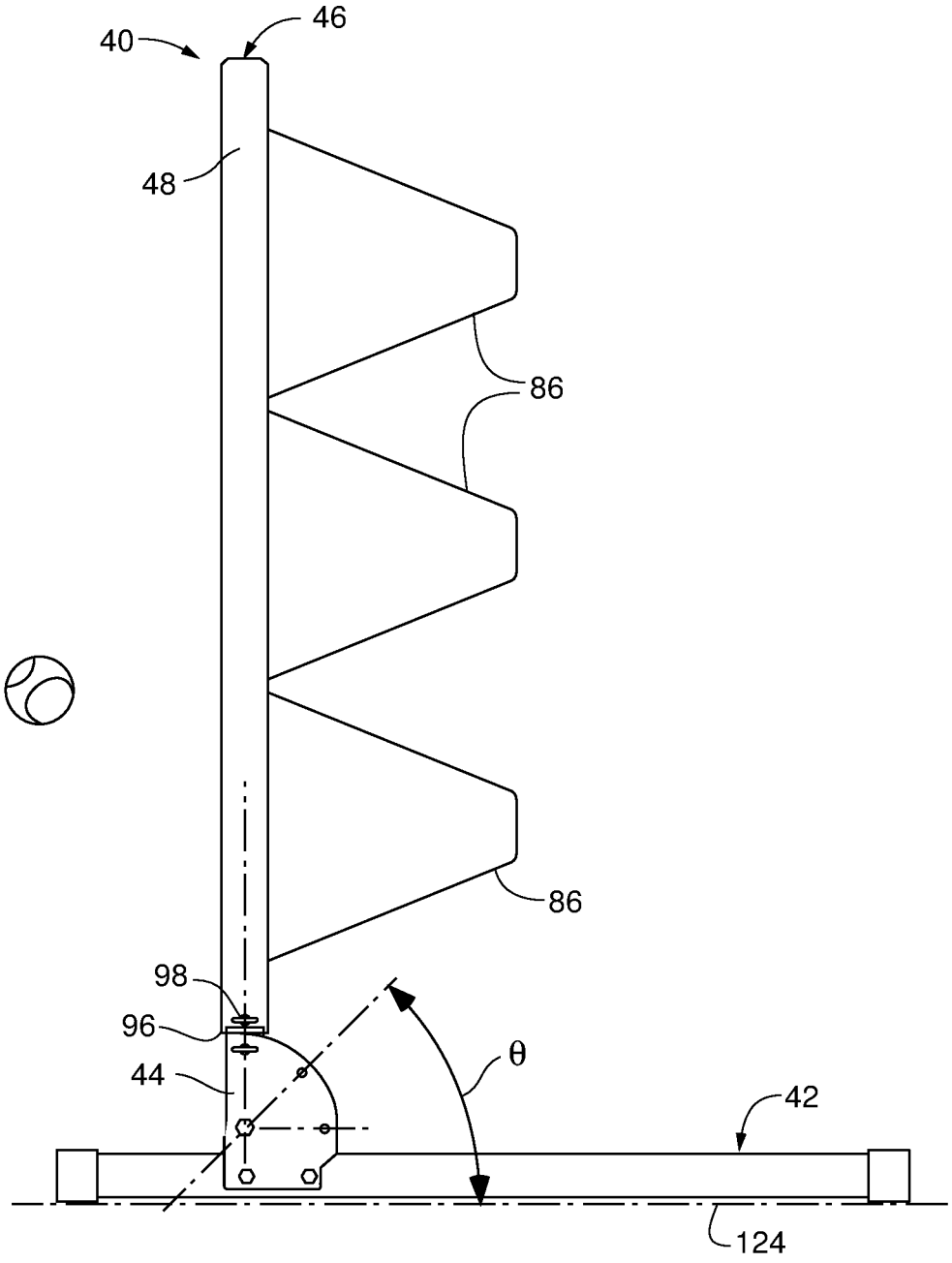
FIG. 3 includes a side elevational view of the pitching target assembly of FIG. 1 according to an embodiment of the disclosure.

Referring to FIGS. 1 through 3, a pitching target assembly 40 for training baseball or softball pitchers is depicted according to an embodiment of the disclosure. In the depicted embodiment, the pitching target assembly 40 includes a base 42, a pair of struts 44 pivotally coupled to the base 42, and a target frame 46 slidingly coupled to the pair of struts 44. The target frame 46 including a pair of side members 48 separated by a pair of lateral members 52 to define a rectangular opening 54, the side members 48 extending vertically and the lateral members extending horizontally when the target frame 46 is in an upright position. A vertical span 53 of the target frame 46 is defined between the lateral members 52 and a horizontal span 55 is defined between the side members 48 pf the target frame 46. Also in the depicted embodiment, a netting assembly 60 includes a plurality of vertically extending elastic cords 56 and a plurality of horizontally extending elastic cords 58 coupled to a netting 62. The plurality of vertically extending elastic cords 56 extend from and between the lateral members 52, and the plurality of horizontally extending elastic cords 58 extend from and between the side members 48. The vertically extending elastic cords 56 are identified individually by the reference character 56, followed by a letter suffix (e.g., reference character 56*a* identifying the uppermost vertically extending elastic cord in FIG. 2). Likewise, the horizontally extending elastic cords 58 are identified individually by the reference character 58, followed by a letter suffix (e.g., reference character 58*a* identifying the leftmost vertically extending elastic cord in FIG. 2).

The plurality of vertically and horizontally extending elastic cords 56 and 58 define a plurality of grid zone perimeters 82, each grid zone perimeter 82 bounding a respective grid zone 84. The netting 62 may be oversized relative to the size of the target frame 46 so that the netting 62 can sag from the vertically and horizontally extending elastic cords 56 and 58 to define a plurality of pouches or pockets 86, each being coupled to a respective one of the plurality of grid zone perimeters 82. The grid zones 84 are identified individually by the reference character 84, followed by a letter suffix (e.g., reference character 84*e* identifying the middle grid zone in FIG. 2). The pair of lateral members 52 may be configured for laterally positioning at least one of the plurality of vertically extending elastic cords 56 at selected locations along the pair of lateral members 52. Likewise, the pair of side members 48 may be configured for vertically positioning at least one of the plurality of horizontally extending elastic cords 58 at selected locations along the pair of side members 48, for changing the sizes of the grid zones 84.

The depicted embodiment includes four vertically extending elastic cords 56 and four horizontally extending elastic cords 58 which divide the target frame 46 into three columns and three rows for a total of nine grid zones 84. It is contemplated that more or fewer elastic cords 56 and 58 could be utilized. For example, three vertically extending elastic cords 56 and three horizontally extending elastic cords 58 would divide the target frame 46 into two columns and two rows for a total of 4 grid zones 84. Five vertically extending elastic cords 56 and five horizontally extending elastic cords 58 would divide the target frame 46 into four columns and four rows for a total of 16 grid zones 84. And so on.

The members 48, 52 of the target frame 46 include inside portions 92 that face inwardly, toward each other, and define the boundaries of the opening 54. In the depicted embodiment, the plurality of vertically extending elastic cords 56 are anchored to the inside portions 92 of the lateral members 52, and include terminations 95 (e.g., FIG. 10) that are registered within the lateral members 52. Likewise, in the depicted embodiment, the plurality of horizontally extending elastic cords 58 are anchored to the inside portions 92 of the side members 48, and include the terminations 95 that are registered within the side members 48. Each of the side members 48 may further define apertures 94 proximate a lower end 96 of the side member 48. The apertures 94 are configured to accept a lynchpin 98 that passes through the side member 48 and the strut 44.

Figure 4:
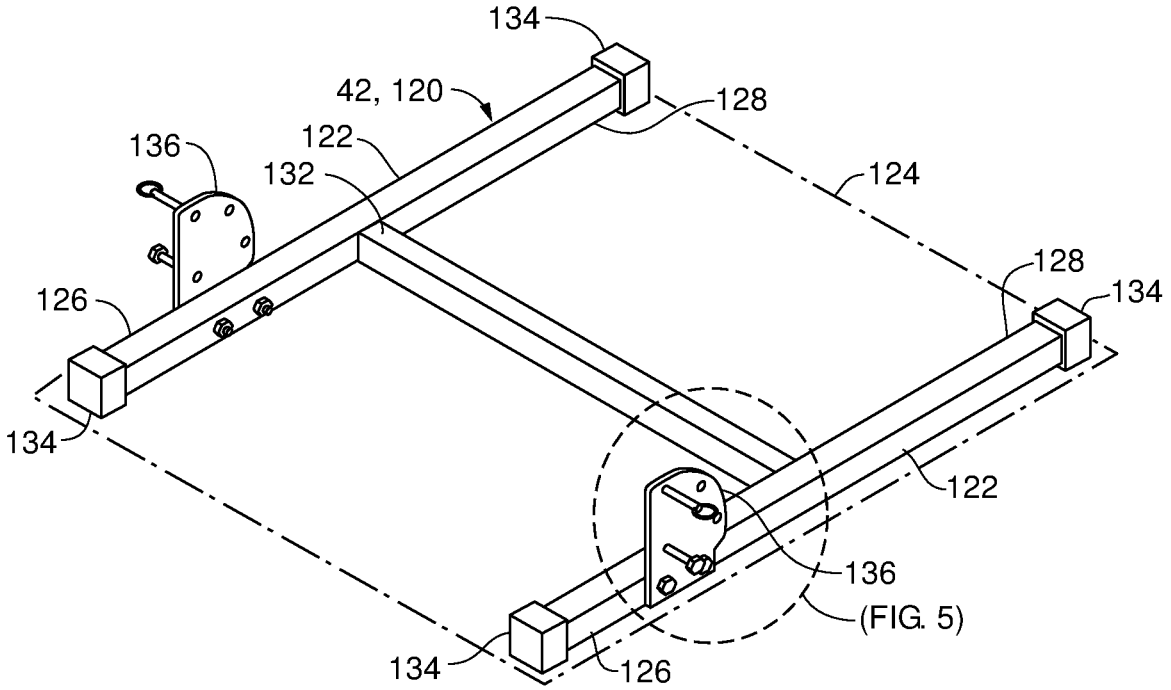
FIG. 4 depicts a base and mounting brackets of the pitching target assembly of FIG. 1 according to an embodiment of the disclosure.
Figure 5:
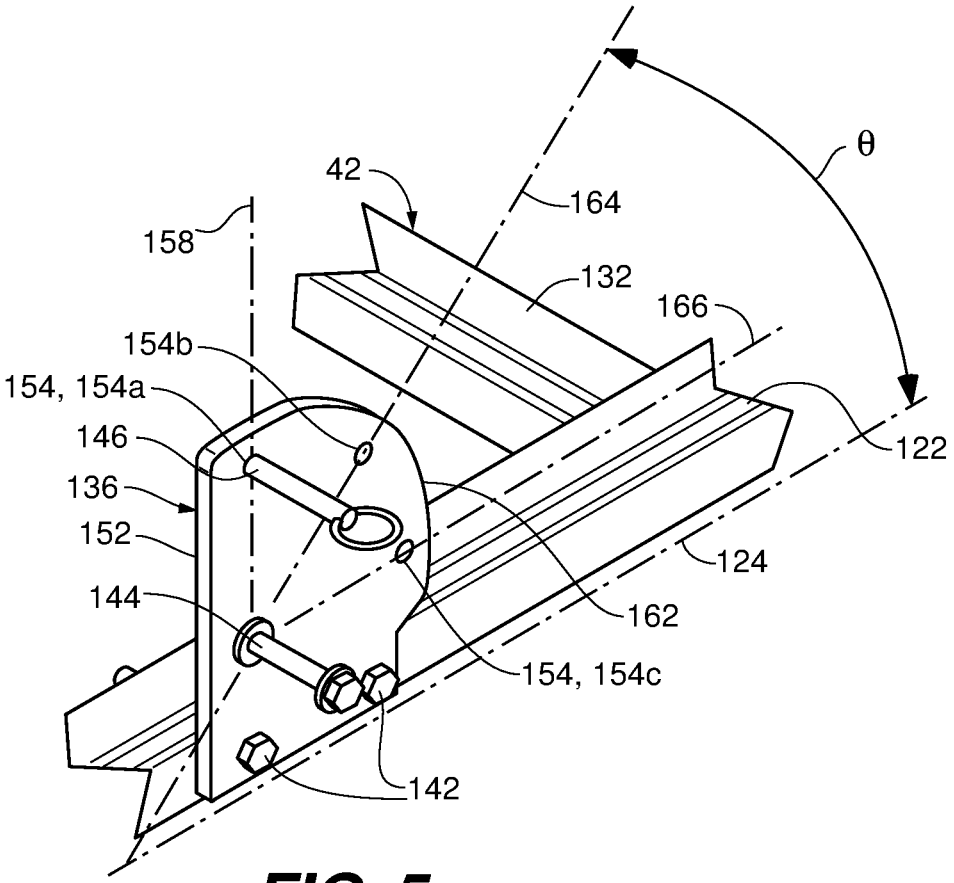
FIG. 5 is an enlarged, partial perspective view of the base and bracket of FIG. 4 according to an embodiment of the disclosure.

Referring to FIGS. 4 and 5, the base 42 is depicted according to an embodiment of the disclosure. In the depicted embodiment, the base 42 includes a frame 120 with side rails 122, the side rails 122 defining a base plane 124 and each having a forward end 126 and a rearward end 128. More generally, the base plane 124 defines reference datum from which other components and features of the pitching target assembly 40 is referenced, regardless of the form or structure of the base 42. The side rails 122 may be separated by a cross member 132. Caps 134 may be installed on the forward and rearward ends 126 and 128 of the side rails 122.

Also in the depicted embodiment, a pair of brackets 136 are disposed proximate the forward of center of the base 42. The brackets 136 may be attached to the base 42 with fasteners 142, or alternatively, welded to the base 42. In some embodiments, each bracket 136 is configured to receive an anchor pin 144 and a set pin 146. The set pin 146 may be a fastener (such as a nut and bolt), a straight pin with an aperture to accommodate a cotter pin, or other pin configurations available to the artisan. In the depicted embodiment, the anchor pin 144 is positioned proximate a forward edge 152 of the bracket 136. The bracket 136 may define a plurality of holes 154 configured to receive the set pin 146. A first hole 154*a* of the plurality of holes 154 is above the anchor pin 144 and may be proximate an upper edge 156 of the bracket 136, to define an upright articulation axis 158 between the anchor pin 144 and the first hole 154*a*. A second hole 154*b* of the plurality of holes 154 may be proximate a rearward edge 162 of the bracket 136 and centered at an acute angle θ to define an angled articulation axis 164 relative to the base plane 124 that extends through the second hole 154*b* and the anchor pin 144. A third hole 154*c* of the plurality of holes 154 may also be located proximate the rearward edge 162 and define a horizontal articulation axis 166 that is substantially parallel to the base plane 124. Additional intermediate holes (not depicted) may be defined on the brackets 136 to define additional angled articulation axes relative to the base plane 124 that pass through the anchor pin 144. The plurality of holes 154 and the location of the anchor pin 144 are mirrored on the brackets 136 on or proximate opposing sides of the base 42.

Figure 6:
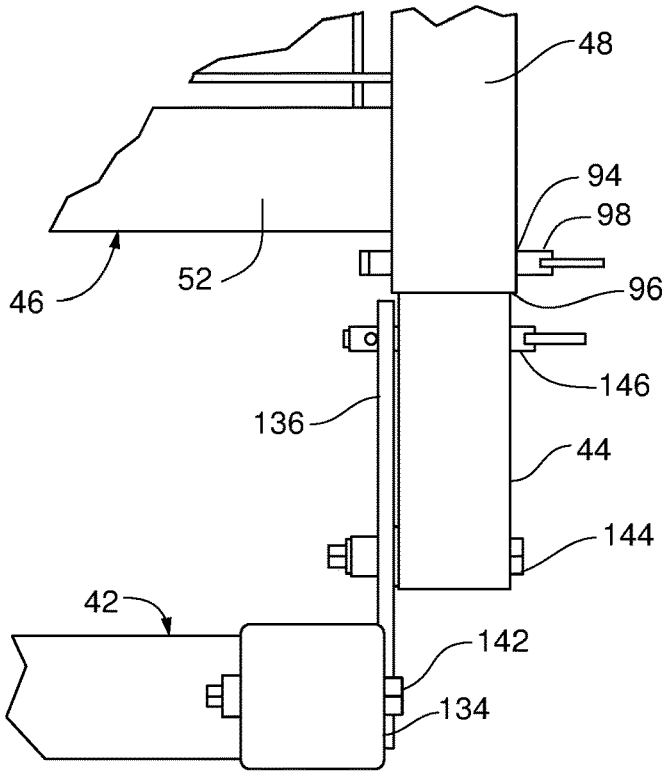
FIG. 6 is an enlarged, partial perspective view of the pitching target assembly of FIG. 1.
Figure 7:
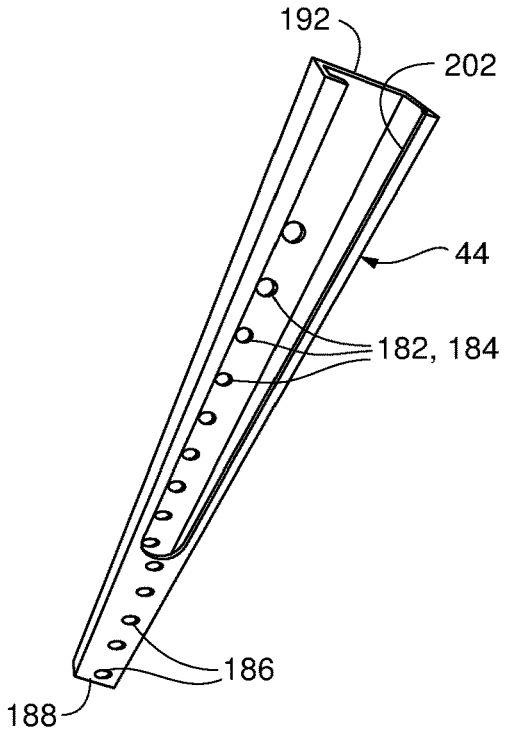
FIG. 7 is a perspective view of a strut that defines a bypass slot according to an embodiment of the disclosure.
Figure 8:
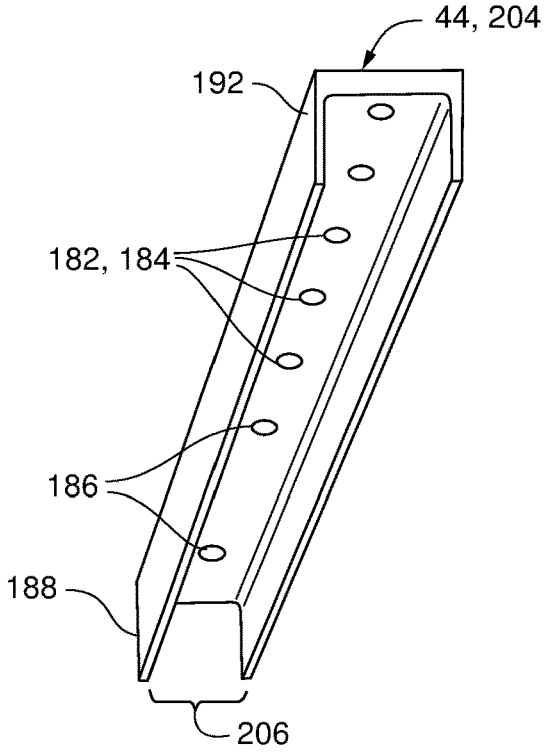
FIG. 8 is a perspective view of a strut configured from a channel according to an embodiment of the disclosure.

Referring to FIGS. 6 through 8, the struts 44 are depicted in assembly and in isolation according to embodiments of the disclosure. In some embodiments, the side members 48 of the target frame 46 are configured to translate relative to the pair of struts 44. In the depicted embodiment, the struts 44 extend into the side members 48, so that the target frame 46 can be slid over the struts 44. The target frame 46 may be configured for coupling to the pair of struts 44 at a plurality of selected locations 182 along the pair of struts 44. In the depicted embodiments, the plurality of selected locations 182 are defined by a plurality of apertures 184 formed in each of the struts 44. The apertures 184 are configured to enable the lynchpin 98 to be passed therethrough. Each strut 44 may also include base apertures 186 defined proximate a bottom end 188 of the strut 44, through which the anchor pin 144 and the set pin 146 pass to mount the strut 44 to the respective bracket 136.

In some embodiments, each of the pair of struts 44 defines a longitudinal slot 202 that extends over at least a portion thereof and extending through a top end 192 of the strut 44 (FIG. 7). In assembly, each of the longitudinal slots 202 are adjacent the inside portion 92 of the respective side member 48. Alternatively, each of the pair of struts 44 is a channel 204, wherein an open side 206 of the channel 204 is adjacent the inside portion 92 of the side member 48 (FIG. 8).

Functionally, the apertures 94 near the lower ends 96 of the side members 48 cooperate with the apertures 184 of the struts 44 to enable adjustment of the height of the target frame 46. The target frame 46 is slid along the struts 44 until a desired height of the target frame 46 is attained. The apertures 94 each of the side members 48 are then aligned with a closest of the apertures 184 of the respective strut 44 to secure the target frame 46 at or proximate a desired height.

The longitudinal slots 202 or, alternatively, the open side 206 enable the plurality of horizontally extending elastic cords 58 that are anchored to the inside portions 92 to slide within the struts 44. That is, without the longitudinal slot 202 or open side 206, the terminations 95 of the horizontally extending elastic cords 58, which extend through the inside portions 92 of and into the side members 48, would interfere with the translation of target frame 46 over the struts 44.

Figure 10:
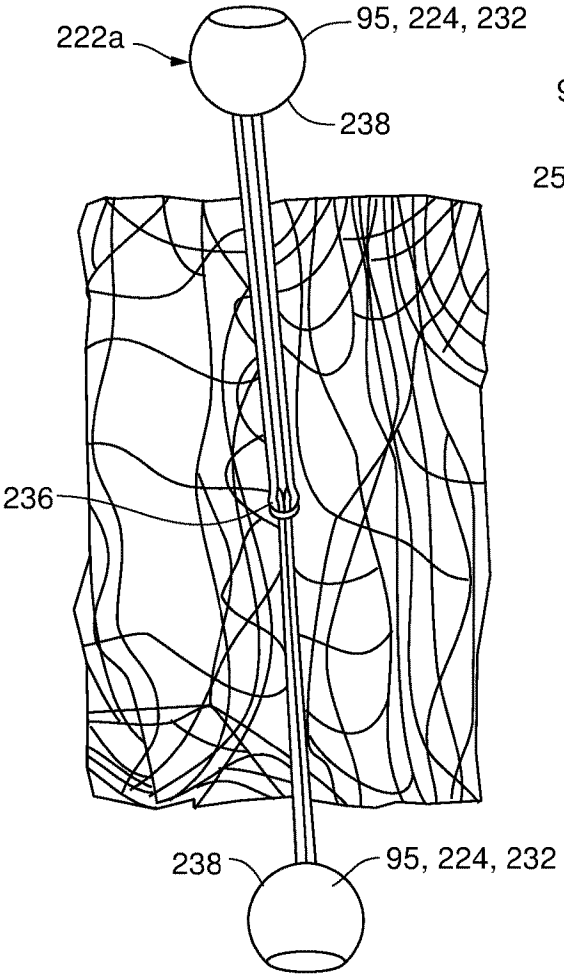
FIG. 10 depicts the elastic cord ball ties tied together according to an embodiment of the disclosure.
Figure 9:
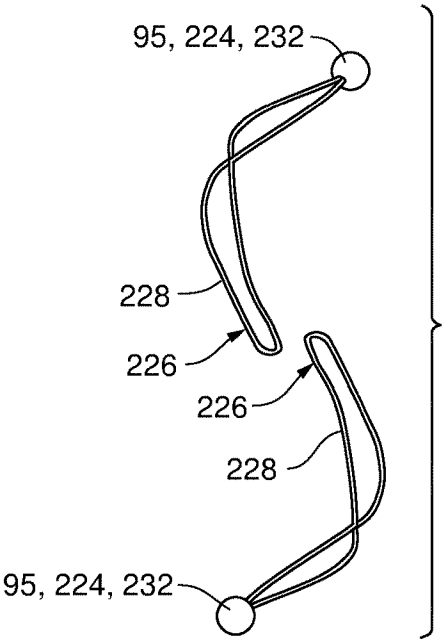
FIG. 9 PRIOR ART
FIG. 9 are conventional elastic cord ball ties for use on the pitching target assembly of FIG. 1 according to an embodiment of the disclosure.

Referring to FIGS. 9 and 10, an elastic cord assembly 222*a* that may be used for the vertically extending elastic cords 56 and the plurality of horizontally extending elastic cords 58 is depicted according to an embodiment of the disclosure. The terminations 95 of the elastic cord assembly 222*a* may be a fixture 224 dimensioned to be captured within the target frame 46. In the depicted embodiment, the elastic cord assembly 222*a* includes a pair of conventional elastic cord ball ties 226. The elastic cord ball ties 226 may be characterized as looped elastic cord 228 having the ends that are captured within a ball 232. In the depicted embodiments, the looped elastic cords 228 of the pair of elastic cord ball ties 226 are tied together to form a knot 236 and are arranged so that the balls 232 are at opposed ends of the cord assembly 222*a*. In such an embodiment, the balls 232 are the fixtures 224, each defining a spherical profile 238 over at least a portion of the fixture 224.

Figure 11:
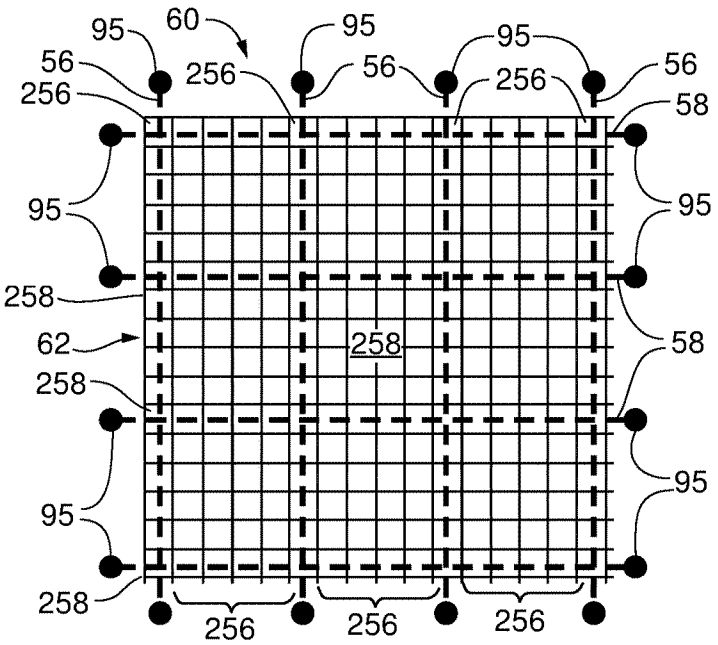
FIG. 11 is a schematic view of a netting assembly with the netting laid out for assembly with elastic cords according to an embodiment of the disclosure.
Figure 12:
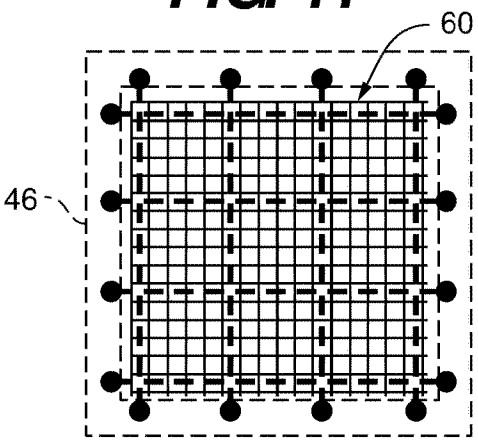
FIG. 12 is a schematic view of the netting assembly of FIG. 11 with the netting contracted to fit within a target frame, according to an embodiment of the disclosure.

Referring to FIGS. 11 and 12, the coupling of the vertically and horizontally extending elastic cords 56 and 58 to the netting 62 to fabricate the netting assembly 60 is schematically depicted according to an embodiment of the disclosure. The coupling of the elastic cords 56, 58 may be done prior to mounting the elastic cords 56, 58 to the target frame 46. In some embodiments, the netting 62 is laid out and columns 252 and rows 254 of the netting 62 identified that define substantially equal swaths 256 of the netting 62 therebetween. The elastic cords 56, 58 are then passed over alternating strands of a mesh 258 of the netting 62 within the respective column 256 or row 258 to loosely couple the netting 60 to the elastic cords 56, 58. Upon mounting the netting assembly 60 to the target frame 46, the netting 62 is contracted relative to the laid out configuration (FIG. 12). The effect of contracting the netting 62 when mounted to the target frame 46 is to create the pockets 86 (e.g., FIGS. 1, 3, and 16).

Figure 13B:
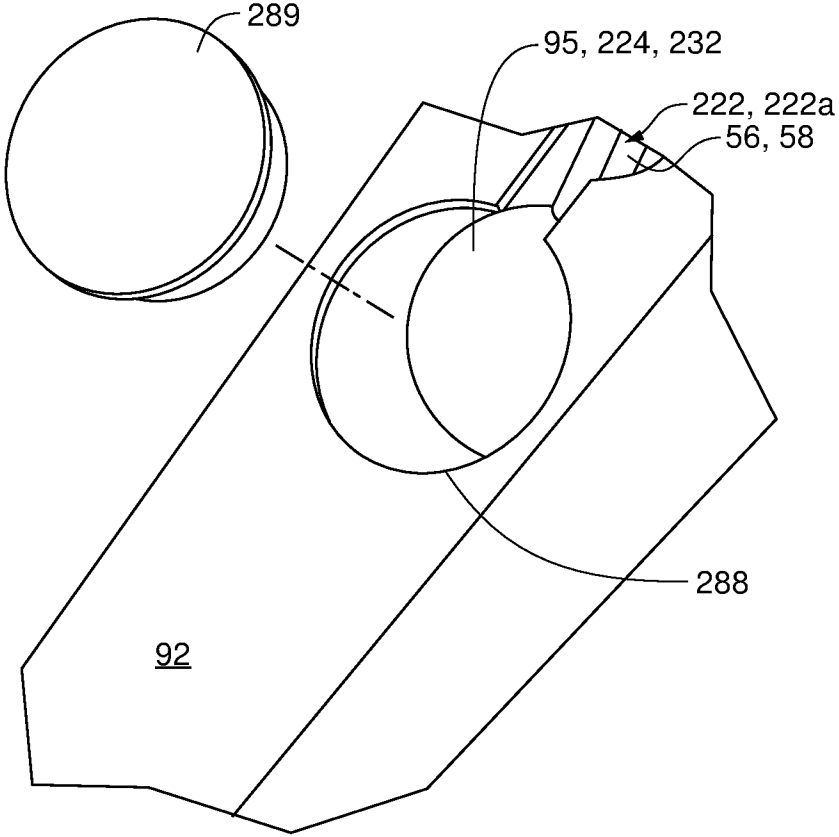
FIG. 13B is an enlarged, perspective view of an access port of the registration slot of FIG. 13A and an access port plug according to an embodiment of the disclosure.
Figure 13A:
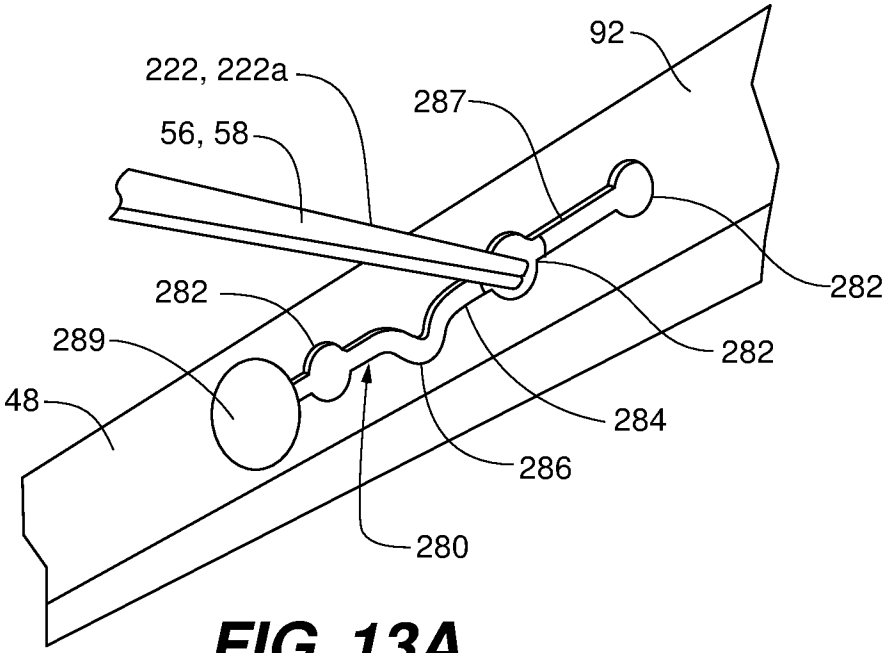
FIG. 13A is a partial, perspective view of an inside portion of a frame member with a registration slot defined thereon according to an embodiment of the disclosure.

Referring to FIGS. 13A and 13B, a registration slot 280 is depicted according to an embodiment of the disclosure. In the depicted embodiment, such registration slots 280 are defined on and pass through the inside portion 92 of each of the pair of side members 48. At least one of the plurality of vertically extending elastic cords 56 is positioned at selected locations along the registration slot(s) 280 defined on the side members 48, and thereby at selected locations along the pair of lateral members 52. Likewise, at least one of the plurality of horizontally extending elastic cords 58 is positioned at selected locations along the registration slot(s) 280 defined on the lateral members 52, and thereby at selected locations along the pair of lateral members 52.

In the depicted embodiment, the registration slot 280 includes a plurality of seating apertures 282 with an elongate slot portion 284 defined therebetween. The elongate slot portion 284 may include a curved or zigzag segment 286, or alternatively may define a straight slot portion 287. In the depicted embodiment, the registration slot 280 includes an access port 288 that defines one end of the registration slot 280. The access port 288 is oversized relative to the termination 95 (e.g., knot or ball 232 or other fixture 224) of the elastic cord 56, 58, to enable passage of the termination 95 through the registration slot 280 and into the target frame 46. A plug 289 may also be included, dimensioned to be accepted by the access port 288. The seating apertures 282 are dimensioned to be undersized relative to the terminations 95 but oversized relative to the elongate slot portion 284. The depicted registration slot 280 defines two seating apertures 282. It is contemplated that more than two seating apertures 282 may be defined, with requisite elongate slot portions 284 extending therebetween.

Figure 14:
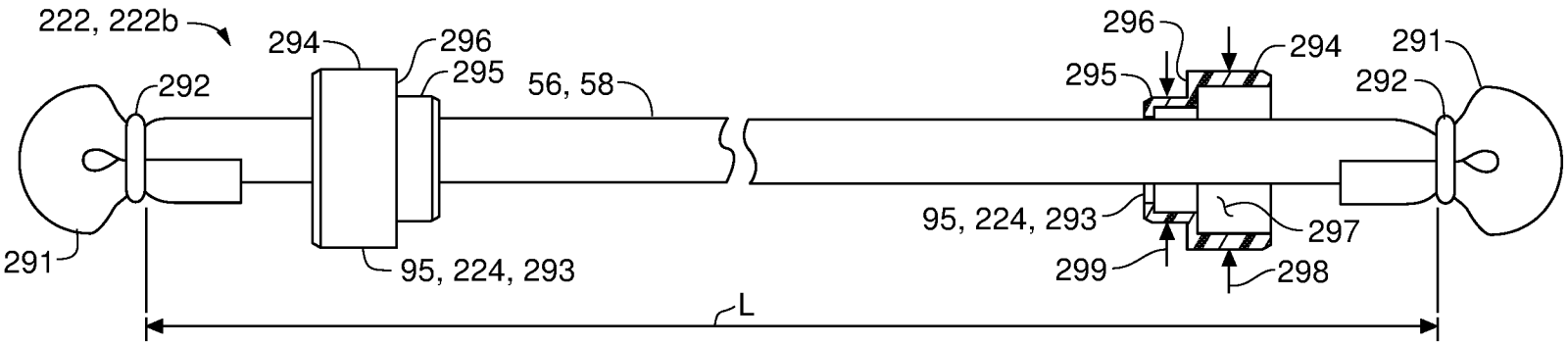
FIG. 14 is a partial sectional view of an elastic cord assembly according to an embodiment of the disclosure.
Figure 14B:
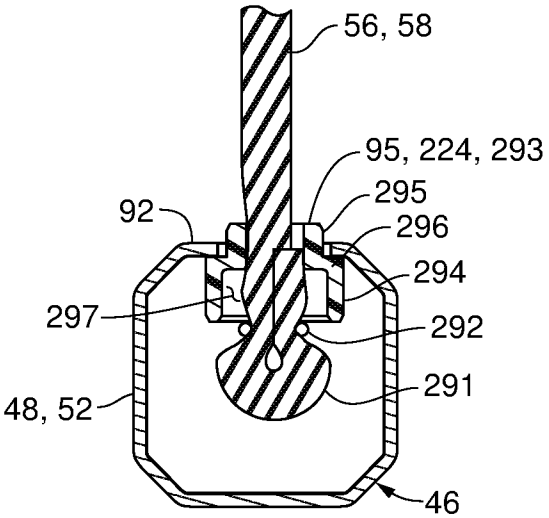
FIGS. 14A and 14B are partial sectional views of the elastic cord assembly of FIG. 14 mounted to a target frame according to an embodiment of the disclosure.
Figure 14A:
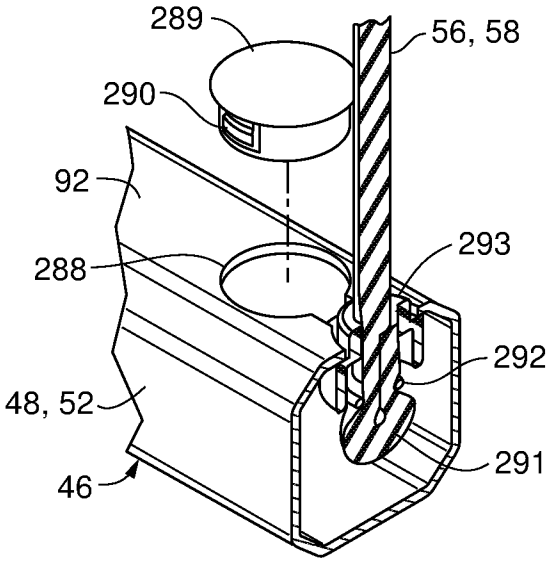

Referring to FIGS. 14 through 14B, an alternative elastic cord assembly 222*b* is depicted in isolation and in assembly according to an embodiment of the disclosure. Herein, elastic cord assemblies are referenced to collectively or generically with reference character 222, with individual or specific elastic cords being referenced by a letter suffix (e.g., elastic cord assembly 222*b*). The elastic cord assembly 222*b* includes the elastic cord 56, 58 having end portions 291 that are folded over and crimped together, for example with a ring or staple 292. A length L is defined between the crimp rings 292, the length L being less than the spans 53 and 55 of the target frame 46 when the elastic cord 56, 58 is not under a tension load. A stepped cylinder 293 located proximate each of the end portions 291 may be utilized as the fixture 224. Each stepped cylinder 293 includes a skirt portion 294 and a neck portion 295 that are joined at a shoulder portion 296 and define a socket 297. The skirt portion 294 defines an outer diameter 298 that is greater than an outer diameter 299 defined by the neck portion 295. Also, the outer diameter 298 of the skirt portion 294 is less than a diameter of the access port 288 but less than a diameter of the seating aperture 282. The outer diameter 299 of the neck portion 295 is less than the diameter of the seating aperture 282. Each stepped cylinder 293 is oriented on the elastic cord 56, 58 so that the respective folded over end portion 291 is received by the skirt portion 294.

Other configurations for elastic cord assemblies 222 are contemplated, for example, a single cord with ends being affixed to conical fixtures (not depicted). It is further contemplated that the doubled over end portions 291 or a knot (not depicted) formed proximate the ends of the elastic cord 56, 58 define the terminations 95, thereby enlarging the diameter of the cord assemblies 222 so that the cords 56, 58 register directly against the inside portion 92 within the frame member 48, 52 of the target frame 46 without use of a fixture 224.

In assembly, the access ports 288 enable initial installation of the elastic cord assemblies 222 within the target frame 46. The termination 95 (e.g., ball 232, stepped cylinder 293, or knotted end), being undersized relative to the access port 288, is inserted through a given access port 288 into the target frame 46 and coupled to the inside portion 92 within the frame member 48, 52. The elastic cord 56, 58 is stretched and the other of the stepped cylinder 293 is inserted in the corresponding access port 288 that is vertically or horizontally opposed to the given access port 288. The stretching of the elastic cords 56, 58 establishes the straight lines of the plurality of grid zones 84. The plug 289 may be inserted into the access port 288 to prevent the termination 95 from slipping out of the access port 288 during the rigors of use. In some embodiments, the plug 289 is secured within the access port 288 by flexible tab portions 290 that snap into place about the perimeter of the access port 288 as the plug 289 is pushed into the access port 288.

In operation, the termination 95 can be slid along the elongate slot portion(s) 284 to a selected location. In the depicted embodiment, the width of the seating apertures 282 are larger than the width of the elongate slot portion 284, but smaller than the size of the termination 95. The termination 95 is positively seated within a given seating aperture 282 by the tension exerted on the elastic cord 56, 58. The curved segment 286 of the registration slot 280 may prevent the termination 95 from drifting to an adjacent seating aperture 282 during the rigors of use. For example, when a baseball impacts an elastic cord 56, 58, the impact can cause the termination to jump out of the seating aperture 282. Over several such impacts, the termination 95 may continue to drift away from the desired seating aperture 282 toward a different seating aperture. The curved segment 286 of the registration slot 280 acts as a barrier that contains and directs dislodged terminations 95 back toward the desired seating aperture 282. To move the termination 95 to another location along the registration slot 280, the user simply pulls the elastic cord 56, 58 in the direction desired for adjustment of the related grid zone 84 with enough force to pass through the curved segment 286 to another location. The stepped cylinders 293 are configured so that neck portions 295 extend through the seating apertures 282 of opposed registration slots 280. The neck portions 295 may be of sufficient length to prevent the stepped cylinders 293 from becoming dislodged from the seating apertures during the rigors of use, thereby securing the elastic cords 56, 58 in place in addition to or as an alternative to the curved segments 286.

In some embodiments, the assembly or operation of the pitching target assembly 40 as described above is included in a set of instructions for the pitching target assembly 40 is made available to the user. The instructions are recorded on a tangible, non-transitory medium (e.g.: a written document that accompanies the pitching target assembly 40; a computer-readable medium such as a compact disk that accompanies the pitching target assembly 40 or is accessible to the user by a remote link up, such as over the internet).

Figure 16:
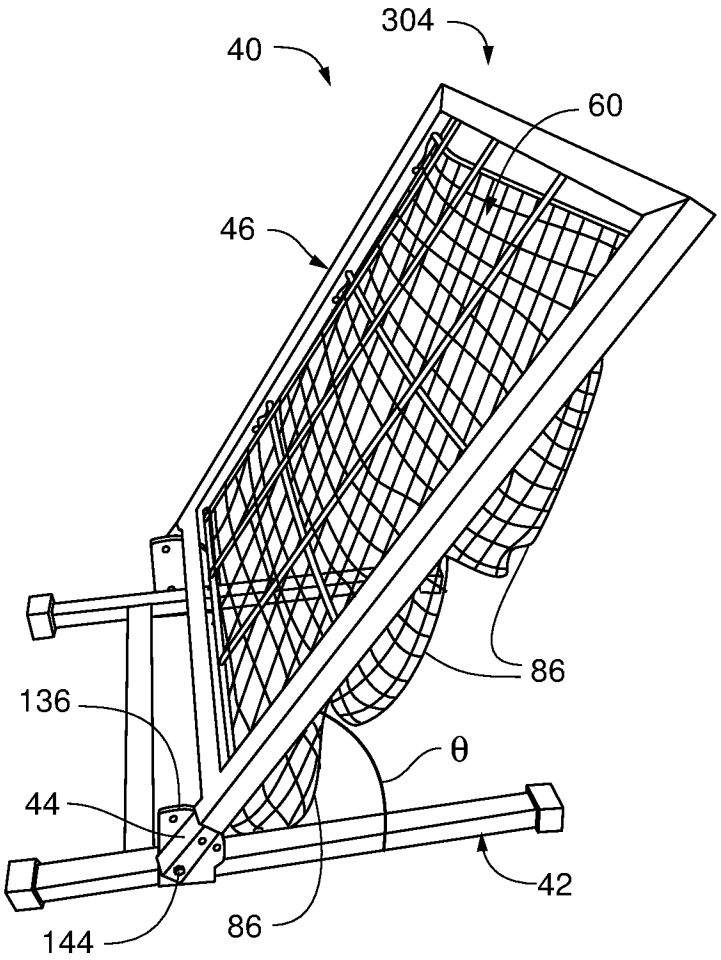
FIG. 16 is front perspective view of the pitching target assembly of FIG. 15 in an angled configuration according to an embodiment of the disclosure.
Figure 15:
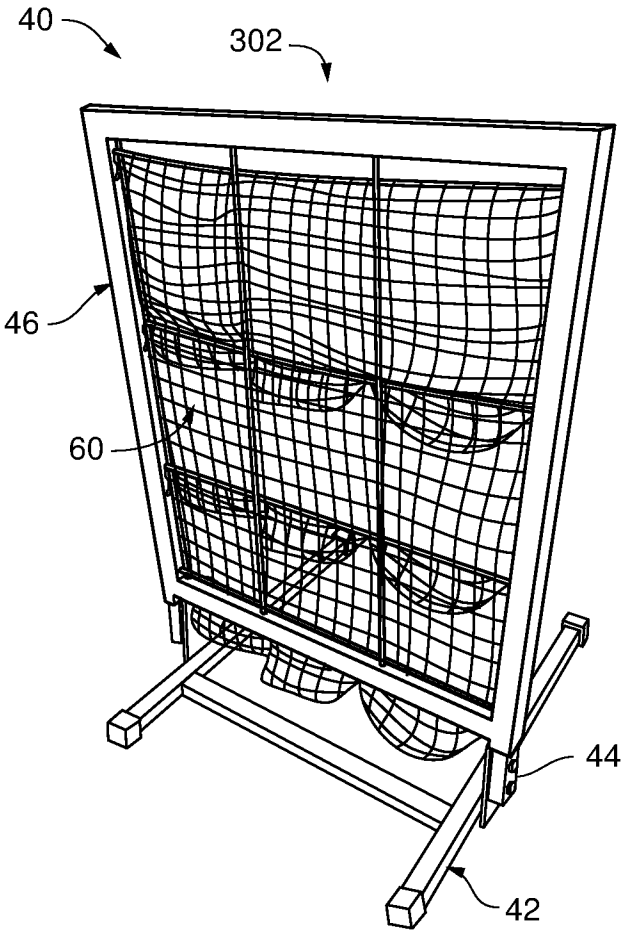
FIG. 15 is a front perspective view of a pitching target assembly in an upright configuration according to an embodiment of the disclosure.

Referring to FIGS. 15 and 16, the pitching target assembly 40 is depicted in an upright configuration 302 and an angled configuration 304, respectively, according to an embodiment of the disclosure. For the depicted embodiment, the upright configuration 302 is obtained by orienting the struts 44 along the upright articulation axes 158 of the brackets 136 (FIG. 5) and securing each strut 44 to the first hole 154*a* with the set pin 146. In the upright configuration 302, the target frame 46 is oriented substantially perpendicular to the base plane 124.

In the depicted embodiment, the angled configuration 304 is be obtained by rotating the struts 44 about the anchor pin and into alignment with the angled articulation axes 164 of the brackets 136. Each strut 44 is then secured to the second hole 154*b* with the set pin 146. Accordingly, for the angled configuration 304, the target frame 46 is oriented at the acute angle θ relative to the base plane 124. In some embodiments, the acute angle θ is in a range of 30 degrees to 60 degrees inclusive. In some embodiments, the acute angle θ is in a range of 35 degrees to 55 degrees inclusive. In some embodiments, the acute angle θ is in a range of 40 degrees to 50 degrees inclusive. The pitching target assembly 40 may also be configurable in a folded configuration (not depicted) where each strut 44 is secured to the third hole 154*c* along the horizontal articulation axis 166 with set pin 146.

Functionally, the ability to configure the pitching target assembly 40 in the angled configuration 304 enables the practicing of drop pitches. The pitching target assembly 40 can be positioned at an appropriate distance from the pitcher so that the grid zones 84 correspond to locations in space where such drop pitches would pass over or behind home plate.

Figure 18:
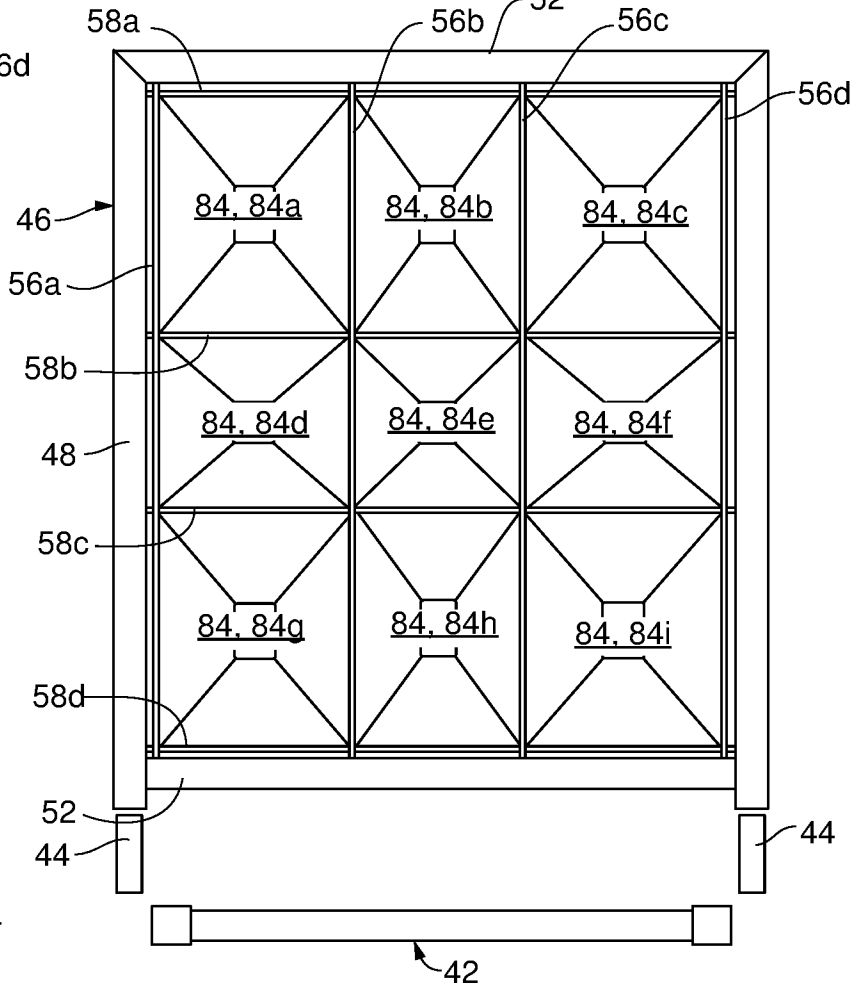
FIG. 18 is a front elevational view of the pitching target assembly of FIG. 1 adjusted for a reduced center grid zone according to an embodiment of the disclosure.
Figure 17:
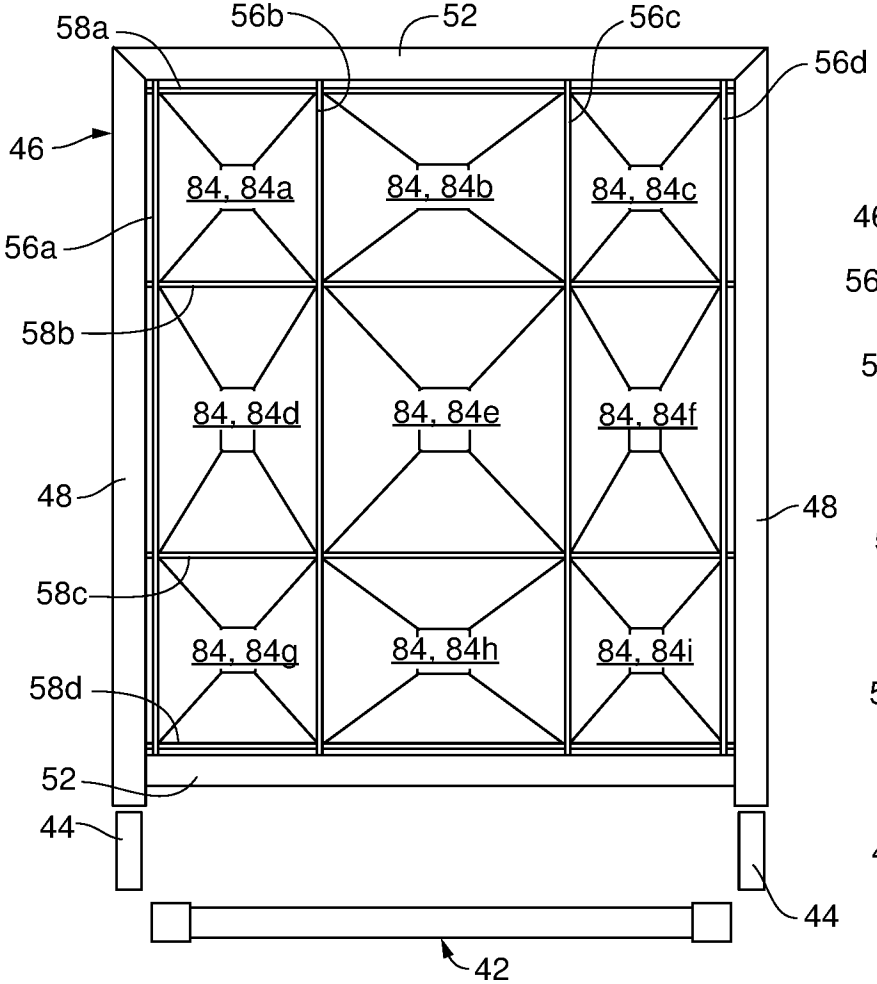
FIG. 17 is a front elevational view of the pitching target assembly of FIG. 1 adjusted for an enlarged center grid zone according to an embodiment of the disclosure.

Referring to FIGS. 17 and 18, the selectability and variability of elastic cords 56, 58 for varying the size of the grid zones 84 is depicted according to an embodiment of the disclosure. In the configuration of FIG. 17, the two vertically extending elastic cords 56*b* and 56*c* are adjusted along the registration slot 280 (FIG. 10) and away from each other relative to the configuration of FIG. 2, to make the middle grid zone 84*e* wider. Similarly, the two horizontally extending elastic cords 58*b* and 58*c* are adjusted along the registration slot 280 and away from each other relative to the configuration of FIG. 2, to make the middle grid zone 84*e* taller. In this way, the middle grid zone 84*e* is made larger, while the other grid zones 84*a*-84*d* and 84*f*-84*i* are made smaller. Conversely, in FIG. 18, the two vertically extending elastic cords 56*b* and 56*c* are adjusted along the registration slot 280 and toward each other relative to the configuration of FIG. 2, to make the middle grid zone 84*e* narrower. Similarly, the two horizontally extending elastic cords 58*b* and 58*c* are adjusted along the registration slot 280 and toward each other relative to the configuration of FIG. 2, to make the middle grid zone 84*e* shorter. In this way, the middle grid zone 84*e* is made smaller, while the other grid zones 84*a*-84*d* and 84*f*-84*i* are made larger.

Functionally, the ability to adjust relative sizes of the grid zones 84 enables a pitcher to focus on hitting preferred areas of or surrounding the strike zone. For example, the grid zones 84 can be tailored to address problems that a pitcher may have with execution, or more generally to train pitchers to hit preferred zones that may arise in certain circumstances.

In the depicted pitching target assembly 40, the base 42, struts 44 and target frame 46 are constructed of square tubing. It is contemplated that these components may also be constructed of circular or rectangular tubing. The materials of construction include steel and aluminum. High density polymers are also contemplated as a construction material.

Figure 20:
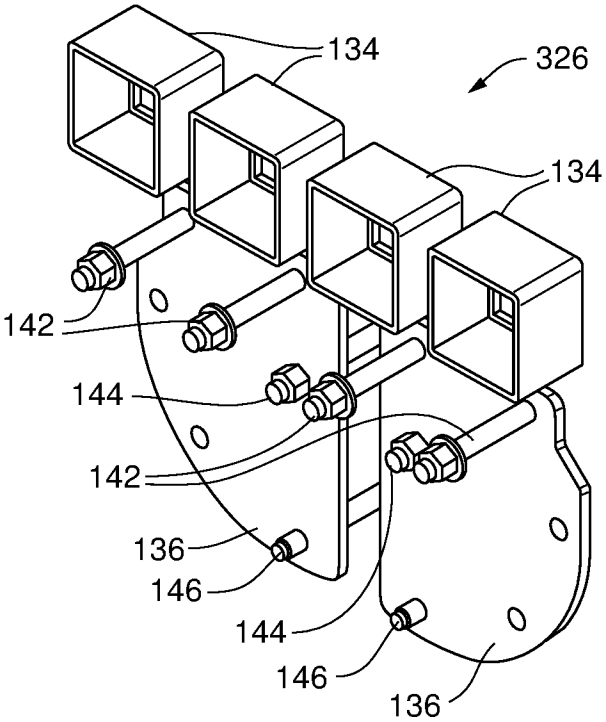
FIG. 20 is a perspective view of various loose components for packaging in the configuration of FIG. 19 according to an embodiment of the disclosure.
Figure 19:
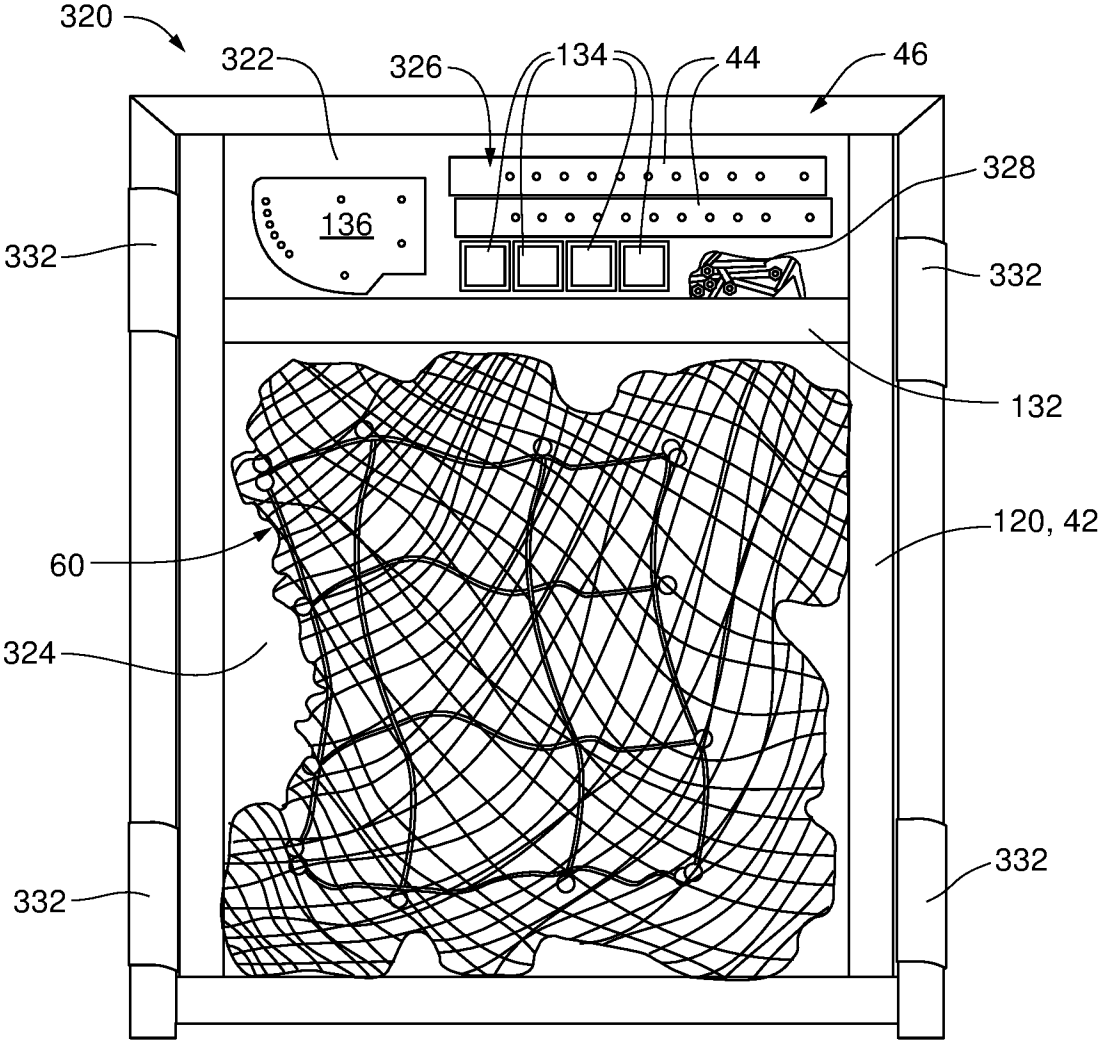
FIG. 19 is a plan view of the pitching target assembly of FIG. 15 disassembled and arranged for shipping according to an embodiment of the disclosure.

Referring to FIGS. 19 and 20, the pitching target assembly 40 is depicted in a shipping configuration 320. In the depicted embodiment, the frame 120 of the base 42 is dimensioned to fit within the target frame 46, such that the cross member 132 serves as a barrier between two zones 322 and 324. The smaller zone 322 may be used to stow loose components 326, such as the struts 44, the caps 134, brackets 136, and a bag 328 containing the various pins and fasteners 142, 144 and 146. The loose components 326, except for the struts 44, are also depicted in FIG. 20. The larger zone 324 may be used to stow the netting assembly 60. The frames 46 and 120 may be secured to each other with tape or wrapping 332, and the shipping configuration 320 slid into a flat box to capture the loose components 326 and the netting assembly 60 within the shipping configuration 320.

Each of the additional figures and methods disclosed herein can be used separately, or in conjunction with other features and methods, to provide improved devices and methods for making and using the same. Therefore, combinations of features and methods disclosed herein may not be necessary to practice the disclosure in its broadest sense and are instead disclosed merely to particularly describe representative and preferred embodiments.

Various modifications to the embodiments may be apparent to one of skill in the art upon reading this disclosure. For example, persons of ordinary skill in the relevant arts will recognize that the various features described for the different embodiments can be suitably combined, un-combined, and re-combined with other features, alone, or in different combinations. Likewise, the various features described above should all be regarded as example embodiments, rather than limitations to the scope or spirit of the disclosure.

Persons of ordinary skill in the relevant arts will recognize that various embodiments can comprise fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

Unless indicated otherwise, references to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A target assembly for baseball or softball pitching, comprising:

a pair of struts;

a target frame slidingly coupled to said pair of struts, said target frame including a pair of side members separated by a pair of lateral members to define a rectangular opening; and a plurality of horizontally extending elastic cords extending from and between said pair of side members, said horizontally extending elastic cords including terminations at opposed ends thereof, said terminations being anchored to inside portions of said pair of side members, wherein:

said target frame is configured to translate relative to said pair of struts and is configured for coupling to said pair of struts at a plurality of selected locations along said pair of struts; and each of said pair of struts defines a longitudinal slot that extends over at least a portion thereof, each of said longitudinal slots being adjacent said inside portion of a respective one of said pair of side members to enable said strut to slide over said terminations of said horizontally extending elastic cords anchored to said inside portion of said side members.

2. The target assembly of claim 1, wherein said pair of struts extend into said pair of side members.

3. The target assembly of claim 2, wherein said pair of struts are pivotally coupled to a base frame.

4. The target assembly of claim 3, wherein said pair of struts and said base frame are configured to selectively support said target frame in one of an upright configuration and in an angular configuration, said pair of side members extending perpendicular to said base plane in said upright configuration, said pair of side members extending at an acute angle relative to said base plane in said angular configuration.

5. The target assembly of claim 4, wherein said acute angle is in a range of 30 degrees to 60 degrees inclusive.

6. The target assembly of claim 4, wherein said acute angle is in a range of 35 degrees to 55 degrees inclusive.

7. The target assembly of claim 4, wherein said acute angle is in a range of 40 degrees to 50 degrees inclusive.

* * * * *